US006615460B1

(12) United States Patent
Baumgarten

(10) Patent No.: US 6,615,460 B1
(45) Date of Patent: Sep. 9, 2003

(54) OPTIONALLY MANUAL OR AUTOMATIC BREAKAWAY LANYARD BUCKLE

(76) Inventor: David Baumgarten, 144 Ottley Dr., Atlanta, GA (US) 30324

( * ) Notice: Subject to any disclaimer, the term of this patent is extended or adjusted under 35 U.S.C. 154(b) by 0 days.

(21) Appl. No.: 10/229,524

(22) Filed: Aug. 27, 2002

(51) Int. Cl.[7] ..... A44B 11/25

(52) U.S. Cl. ..... 24/615; 24/616; 24/625; 24/640; 24/3.12

(58) Field of Search ..... 24/615, 616, 625, 24/640, 3.12

(56) References Cited

U.S. PATENT DOCUMENTS

| | | | | |
|---|---|---|---|---|
| 4,025,991 A | | 5/1977 | Miner | |
| 4,035,877 A | | 7/1977 | Brownson | |
| 4,150,464 A | | 4/1979 | Tracy | |
| 4,282,634 A | | 8/1981 | Krauss | |
| 4,825,515 A | | 5/1989 | Wolterstorff | |
| 5,465,472 A | * | 11/1995 | Matoba | 24/625 |
| 5,507,076 A | * | 4/1996 | Anscher | 24/625 |
| 5,791,026 A | * | 8/1998 | Anscher | 24/615 |
| 6,052,875 A | * | 4/2000 | Fudaki | 24/625 |

* cited by examiner

*Primary Examiner*—Victor Sakran
(74) *Attorney, Agent, or Firm*—David Dolberg

(57) ABSTRACT

The invention describes a lanyard coupler or buckle with an optionally manual or automatic breakaway feature. The buckle includes insert and receptacle members, each of which have a variable insert stop means that can mutually interact either adversely or reciprocally when the insert is placed within the receptacle. Adverse interaction results in partial insertion, frictional coupling, and an automatic release of the members upon application of tensional force. Reciprocal interaction results in full penetration and a locking interactional coupling of the insert arms with the receptacle. Manual compression of the arms is then required for separation of the two members. Lanyard and card attachment means are provided on both members.

14 Claims, 5 Drawing Sheets

OPTIONALLY MANUAL OR AUTOMATIC BREAKAWAY LANYARD BUCKLE

FIELD OF THE INVENTION

The invention relates generally to a buckle and more particularly to a two part clip buckle. More specifically, the invention relates to a two part cooperating clip buckle that can be alternatively oriented to provide either manual or automatic release under tension.

BACKGROUND OF THE INVENTION

Connectors and buckles are commonly used to join together two separate articles or two ends of the same article. Buckles comprising two interlocking parts are well known. See for instance, U.S. Pat. Nos. 4,025,991, 4,035,877, 4,150,464, 4,282634, 6,052,875. The patents describe buckles with male and female parts. The male part is reversibly inserted into the female part and is passively retained within the female by a locking means, usually, resilient arms which are part of the male and which spring outwards into locking grooves of the female upon full insertion. These arms can then be manually compressed to allow withdrawal of the male part. A concern had been that the user would inadvertently cause the release of the buckle. U.S. Pat. No. 4,825,515 is an example of a buckle with an additional locking feature separate from the resilient arms.

However, the opposite concern has been unaddressed. Under some circumstances it would be desirable to provide for automatic rather than manual release of the male part when extraordinary tension is applied separating the male part away from the female. For example this two part buckle system has been used in combination with lanyards as identity card holders. In this application the lanyard goes around the neck of the user and attaches to one member of the buckle. A clip for holding an identity card is attached to the other member. If the user is near automatic machinery, a danger is created if the card were to get caught in the machinery. Therefore, having an automatic release feature would be desirable. Even more desirable would be a buckle that would optionally provide a manual or automatic release mechanism.

SUMMARY OF THE INVENTION

This invention describes a male/female-type buckle for belts and lanyards. In common with other inventions, the insert member can be releasably inserted into the receptacle member and is locked in place be means of two resilient opposed lateral arms extending away from the center of the insert. The arms compress upon insertion, thereby providing spring loading potential energy for their outward expansion. The arms move into locking slots on the body of the receptacle upon full insertion of the insert and spring out into the locked position witin the slot.

This invention provides an alternative automatic or manual release feature depending upon which of the two orientations for insertion of the insert is chosen. The tip of the insert extends further from its base on one leading edge relative to the other (e.g. diagonal). This corresponds to the rear wall of the receptacle which also extends further into the cavity on one edge relative to the other. As a result, when the insert is inserted such that the two diagonals cooperatively overlap each other, full insertion is achieved and the resilient arms, or the locking tab of the arms, are allowed to fully snap into the locking slots of the receptacle. Here, the members can only be separated by manual recompression of the resilient arms.

When the insert is flipped over and inserted conversely, such that the two diagonals are adverse and oppose each other, the insert is stopped short of full insertion only allowing a portion of the locking tab to enter the locking slot thereby providing enough friction to keep the buckle in place, but allowing for an automatic release when an extraordinary tension is applied to separate the two members.

It is an object of this invention to provide a two-part buckle that can be securely fastened It is an object of this invention to provide a two-part buckle that can be manually separated with one hand.

It is also an object of this invention to provide a two-part buckle that can alternatively be automatically released if tension is applied separating the two members.

In accordance with the above objects and others, described herein, an optionally manual or automatic disengaging buckle is provided, comprising separable cooperating insert and receptacle members couplable in a first and second orientation. The receptacle comprises a generally flat rectangularly tubular body having inner and outer side walls relatively wider than top and bottom walls, an open first end for receiving the insert and a closed second end with an inner surface. The inner surface has variable insert stop means including a raised region with a first edge proximate to the inner wall and a second edge proximate to the outer wall. The insert stop is located equidistant between the top and bottom walls and protruding a predetermined distance toward the first end with the first edge protruding relatively further than the second edge. The top and bottom walls include locking means including paired slots located in the top and bottom walls at an equivalent predetermined distance from the first end. The insert comprises a base having a central post extending away from the base. The post includes a tip, inner, outer, upper and lower sides, and also includes variable insert stop means at the tip having a centrally located stop region with inner and outer edges, the outer edge extending relatively further from the base than the inner edge. The insert additionally comprises upper and lower opposing resilient arms with outer sides facing away from the post, the arms having first and second ends and located on opposite upper and lower sides of the post, the first ends springedly attached proximate to the tip of the post with the arms extending alongside of and diagonal to the post and second ends spaced apart relatively further than the distance between the top and bottom walls of the receptacle. The tips of the second ends are flat and generally parallel to the base, and the arms and post dimensioned to fit within the receptacle by compression of the resilient arms toward the post as the insert is moved into the receptacle, such that, when the insert is inserted into the receptacle in the first orientation, the insert stop of the receptacle reciprocally cooperates with the insert stop of the insert, thereby providing full penetration of the insert and snapping engagement of arms into the corresponding locking slots, and when the insert is inserted in the converse orientation relative to the receptacle, the insert stop of the receptacle is adverse to the insert stop of the insert, thereby preventing full penetration of the insert and preventing the flat tips of the arms from entering the locking slot.

In other embodiments, each member is alternatively provided with a means for attaching a belt or lanyard, and a clip for attaching an identification card or card holder.

DETAILED DESCRIPTION OF THE INVENTION

Figure 2A:
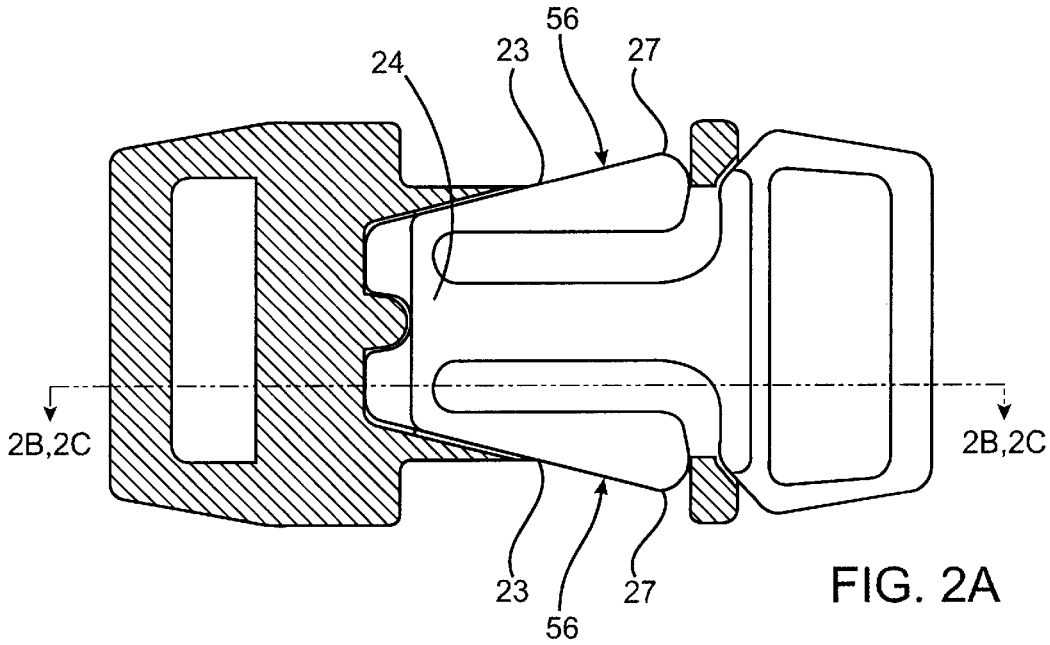
FIG. 2A—Buckle side view, section as shown in FIG. 2B.
Figure 2B:
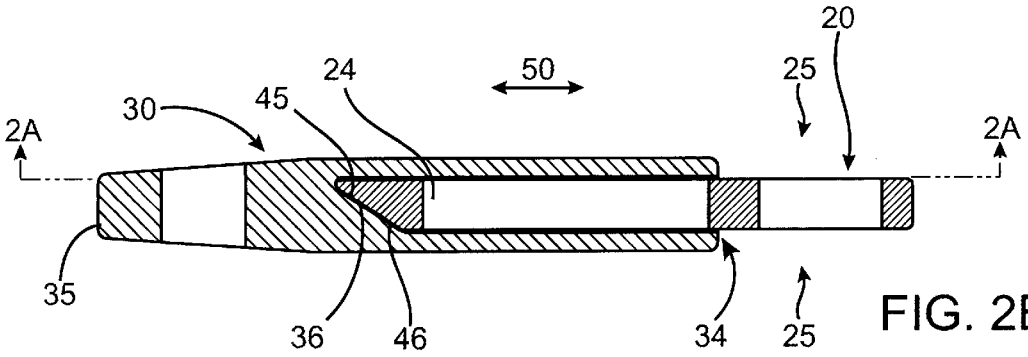
FIG. 2B—Buckle top view (manual orientation), section as shown in FIG. 2A.
Figure 2C:
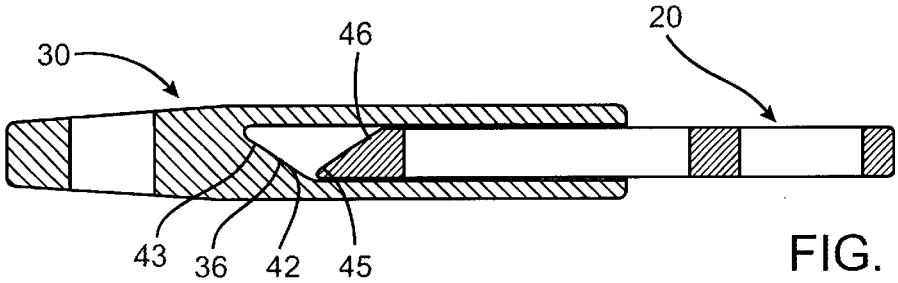
FIG. 2C—Buckle top view (automatic orientation), section as shown in FIG. 2A.

Referring to the drawings, a buckle (10) with an optionally automatic or manual breakaway feature, constructed in accordance with this invention, is described. The buckle (10) comprises two separable, cooperating members, an insert member (20—insert) and a receptacle member (30—receptacle), and is typically molded from a hard plastic material such as Delrin or nylon. Both the insert (20) and the receptacle (30) include variable insert stop means which, depending upon the relative orientation of the two components, determines whether the closed or coupled buckle will release only through manual manipulation (FIG. 2B), or automatically (FIG. 2C) upon application of tension force (50) between the two members. Both the insert (20) and receptacle (30) further include interacting locking means which provide for releasibly coupling the insert and receptacle.

The receptacle comprises a generally flat, narrow, rectangularly tubular body (31) having relatively wide, matched inner and outer side walls (32) and narrow, matched top or upper walls and bottom or lower walls (33), the walls forming a cavity (37). Typically, the side walls (32) are from ¼ inch to 2 inches wide and the top and bottom walls (33) are from ⅛ inch to ½ inch wide. Typically, the ratio of side to top varies from about 4:1 to 2:1. The receptacle also includes an open first end (34) through which the insert (20) can be inserted, and a closed, or partially closed second end (35). The inner surface (36) of the closed end is provided with a variable insert stop means which includes a raised region (41) with a first (42) and second (43) edge, each edge adjacent to a side wall. The region is located generally central between the top and bottom wall (33). The first edge (42) protrudes further into the cavity (37) and toward the open first end (34) relative to the second edge (43). The protruding distance is predetermined based on the dimensions of locking means as described below. In this embodiment, the raised region is contoured as a continuous diagonal. Alternatively, the raised region is stepped. The contour of the raised region (41 ) complements variable insert stop means in the insert as described below. Generally, the region (41) occupies at least the middle third of the closed end (35) between the top and bottom walls (33) and may fully extend between the walls. The top and bottom walls additionally include locking means comprising paired slots (56), one in each wall and each placed at the same distance from the first end (34). The dimensions of these slots (56) are predetermined and adapted to receive locking means of the insert (20) as described below. In a preferred embodiment, the opening of the slots (56) is extended down into the inner and outer walls for a short distance. This facilitates the manual releasing or disengaging operation.

Figure 1A:
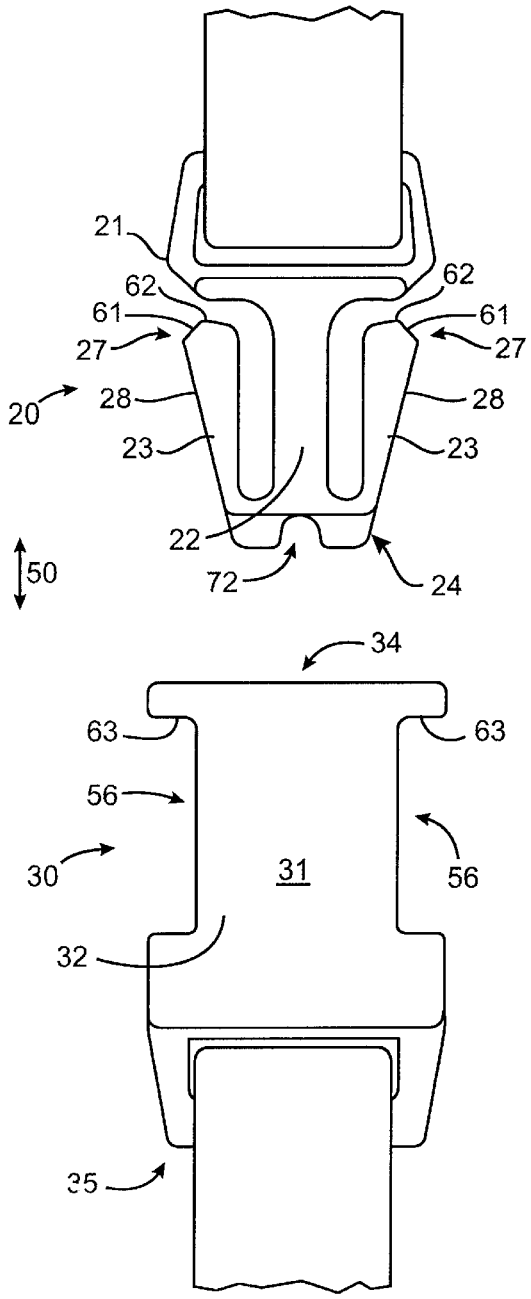
FIG. 1A—Buckle side view: Insert and Receptacle
Figure 1B:
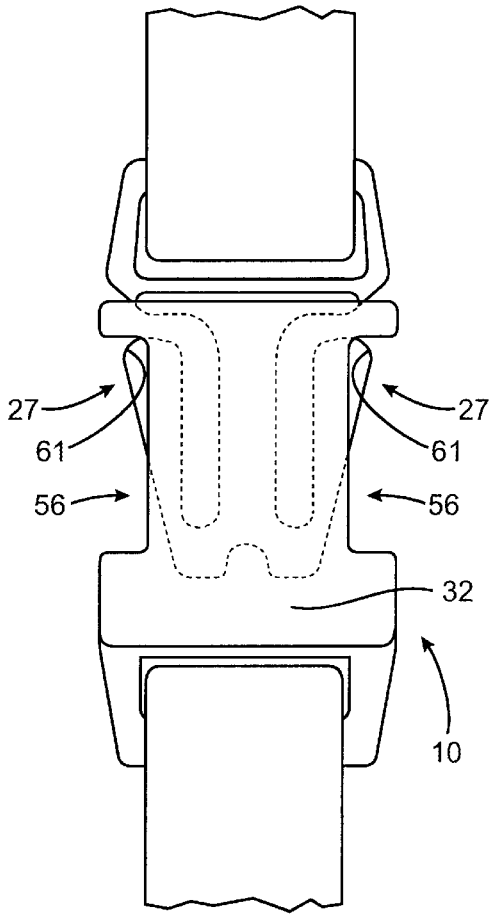
FIG. 1B—Engaged Buckle

In a first embodiment (FIG. 1), the insert (20) comprises a generally rectangular base (21) with a central post (22), and paired resilient arms (23) with first ends springedly and resiliently attached to the post (22) at the post tip (24) and the arms extending diagonally away from the post back toward the base (21) along opposite lateral (top and bottom) sides of the post (22), forming an arrowhead-like shape. The base (21) is generally as long from top to bottom as the distance between the top and bottom walls (33) of the receptacle. The tip of the post (24) includes variable insert stop means comprising a central raised region (44) with first (45) and second (46) edges adjacent to the inner and outer sides (25) of the insert (20). The first edge (45), adjacent to a side of the insert, extends further from the base relative to the second edge (46). The differential between the two edges in the raised region (44) corresponds to the differential of the edges in the raised region (41) at the closed end of the receptacle.

The second or distal ends (27) of the resilient arms (23) are spaced apart at a distance somewhat further than the distance between the top and bottom walls of the receptacle (30). It is to be understood that the arms (23) and post (22) are dimensioned to fit snugly into the cavity (37) of the receptacle (30) and that upon entry of the insert (20) into the receptacle (30), the arms (23) are compressed somewhat to allow for the entry. The arms (23) include locking means (55) at the distal second ends (27). Locking means comprise the flat tip (62) at the distal end of each arm (27) and a transitional shoulder (61) from the tip (59) to the lateral side (28) of the arm. The tip (59) is cut such that, when the insert (20) is fully inserted, the tip (62) is parallel to the edge (63) of the slot (56).

Figure 4:
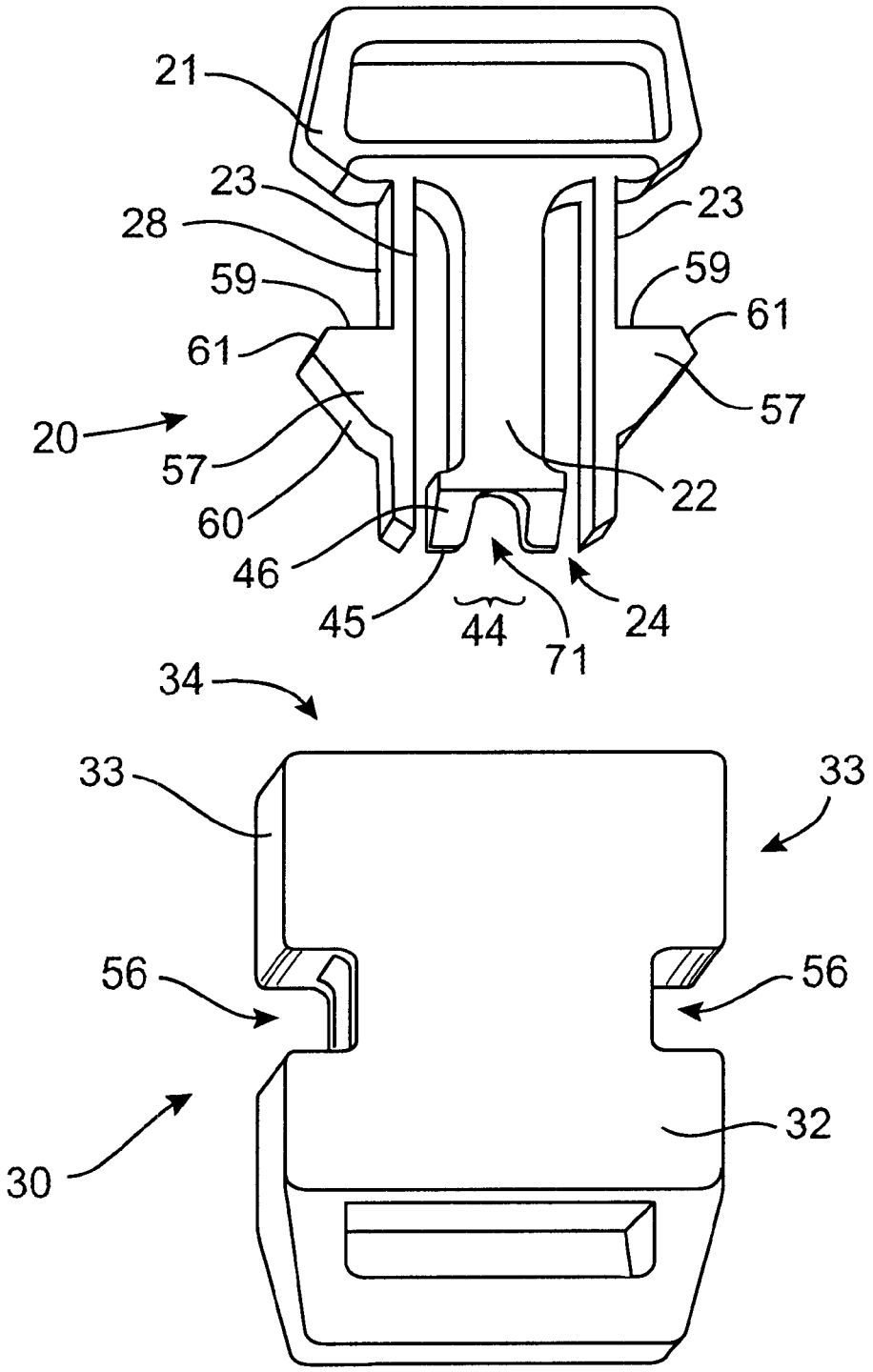
FIG. 4—Buckle side view, alternate embodiment of insert.

In a second embodiment (FIG. 4), the paired arms (23) of the insert (20) are springedly and resiliently attached to the same side of the base (21) at opposite ends, and extend away from the base. The arms are spaced a distance apart corresponding to the distance between the top and bottom (33) of the receptacle (30). The base also includes a central post (22) between the two arms . The post is located central and extends away from the base in the same direction as the arms. The distal tip (24) of the post includes variable insert stop means comprising a central raised region (44) with a first (45) and second edge (46). The first edge extends further from the base relative to the second edge (46). The differential between the two edges (45 & 46) corresponds to the differential of the edges (42 & 43) within the raised region (41) at the closed end of the receptacle (30). It is to be understood that the arms (23) and post (22) of the insert (20) are dimensioned to fit snugly into the receptacle (30) and that the upon entry of the insert into the receptacle, the arms (23) are compressed together somewhat to allow for the entry. The arms include locking means on their lateral sides (28). The locking means of the insert comprises a locking tab (57) on each arm which includes a trailing edge (59) facing toward the base, a lateral side (60) and a transitional shoulder (61) therebetween. The lateral sides (60) are spaced apart at a distance somewhat further than the distance between the top and bottom walls (33) of the receptacle, thereby requiring compression of the arms (23) toward each other for insertion of the insert (20) and additionally providing for the springing of the tabs (60) into the locking slots (56) and snapping engagement upon full insertion.

Operationally, both embodiments of the insert member interact in the same way with the receptacle. It is to be understood that the insert may be inserted into the receptacle in either of two orientations. In the first, or manual orientation (FIG. 2B), when the raised regions (41 & 44) of the variable insert stop means of the insert (20) and receptacle (30) are complementary (the protruding edges 42 & 45 on opposite sides) the stop means of the insert reciprocally and cooperatively overlaps with the stop means of the receptacle and the insert can be fully inserted into the receptacle. In the first embodiment of the insert, the distal ends (27) of the arms (23) snap into the locking slots (56) and the flat tips (62) of the arms are within the slots and engage the edges of the slots (63) closest to the opening of the receptacle. In the second embodiment of the insert, the trailing edge (59) of the locking tab (57) snap into the locking slots (56) and engage the edges (63) of the slots. To manually disengage the two members, the user presses the two arms together and simultaneously pulls (50) the insert from the receptacle.

In the converse, or automatic orientation (FIG. 2C), the raised regions (41 & 44) are in oppositional or adverse relation (the protruding edges 42 & 45 on the same side). The stop means of the insert and receptacle can not overlap and the insert (20) is prevented from being fully inserted by a distance equal to the distance between the first (4w) and second (46) edge of the insert. This permits only the shoulders (61) of the arms (23) (in the first embodiment) or of the tabs (57) (in the second embodiment) to enter the locking slot (56). This provides a frictional interaction of the insert and receptacle, however, the arms of the insert will compress and the two members will automatically release when sufficient tensional pressure (50) is applied. The user is thus able to optionally chose the preferred orientation and operation.

EXAMPLES

Examples are provided to highlight certain desirable features of the buckle of the present invention.

Figure 3:
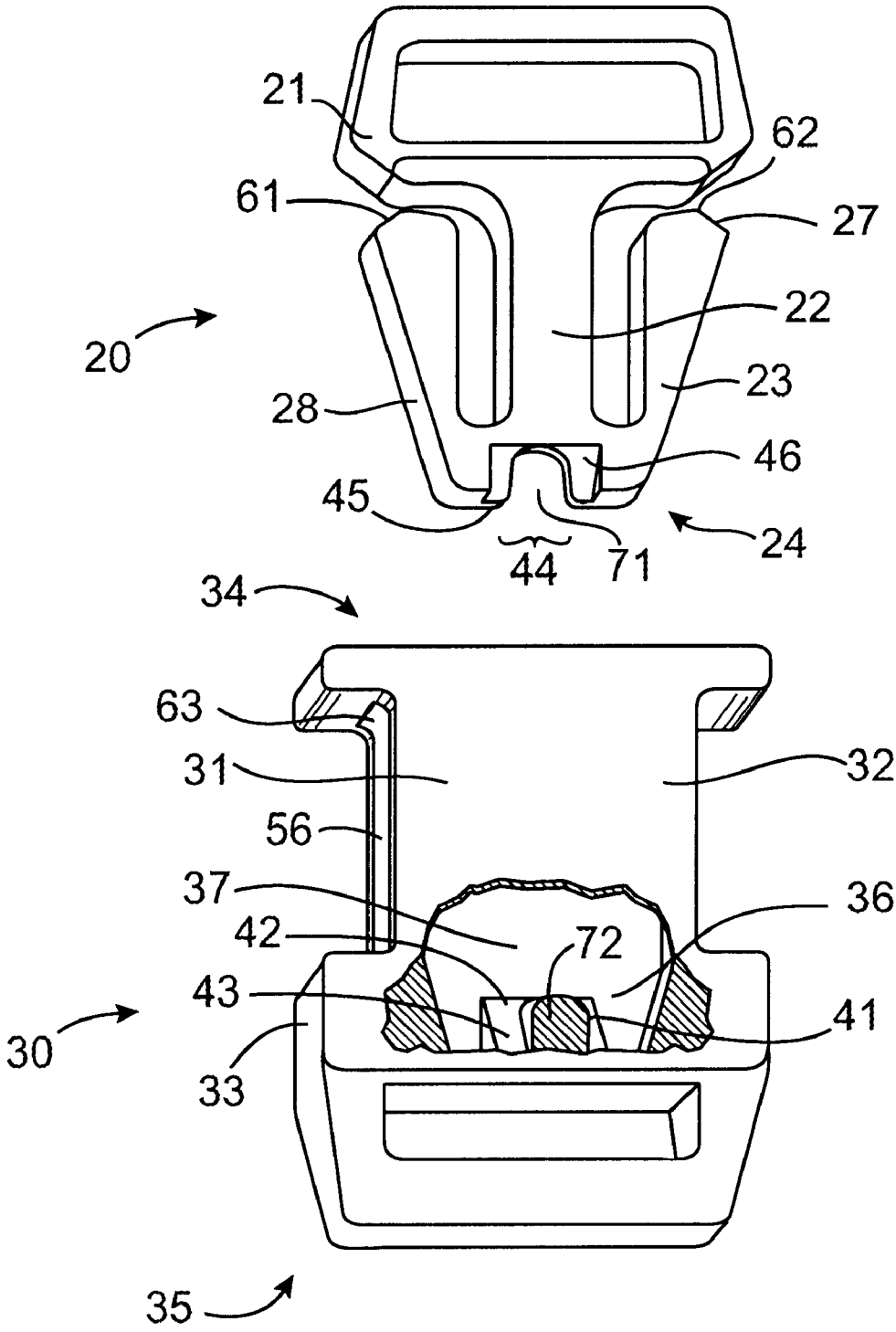
FIG. 3—Buckle side view (automatic orientation), partial cutaway of receptacle.

As best seen in FIG. 3, the arms extend beyond the tip of the central post, forming a central indentation (71) at the tip of the insert. A centering tab (72) corresponding to this groove is centrally located at the closed end of the receptacle. When the insert is inserted-into the receptacle, the interaction of the centering tab (72) and the indentation (71) serve to maintain the desired alignment of the insert relative to the receptacle. The indentation (71) is located within the raised region (44) of the insert and the centering tab (72) is located within the raised region. (41 ) of the receptacle. It will be appreciated that, in other embodiments, the centering tab (or tabs) is located on the insert and the corresponding indentation(s) is in the receptacle.

Figure 5A:
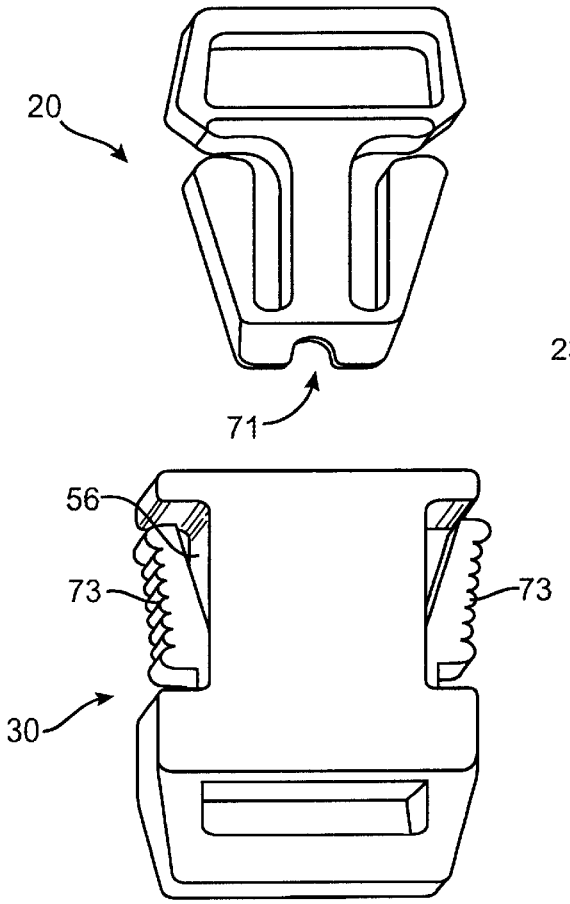
FIG. 5A—Buckle side view, alternate embodiment of receptacle.
Figure 5B:
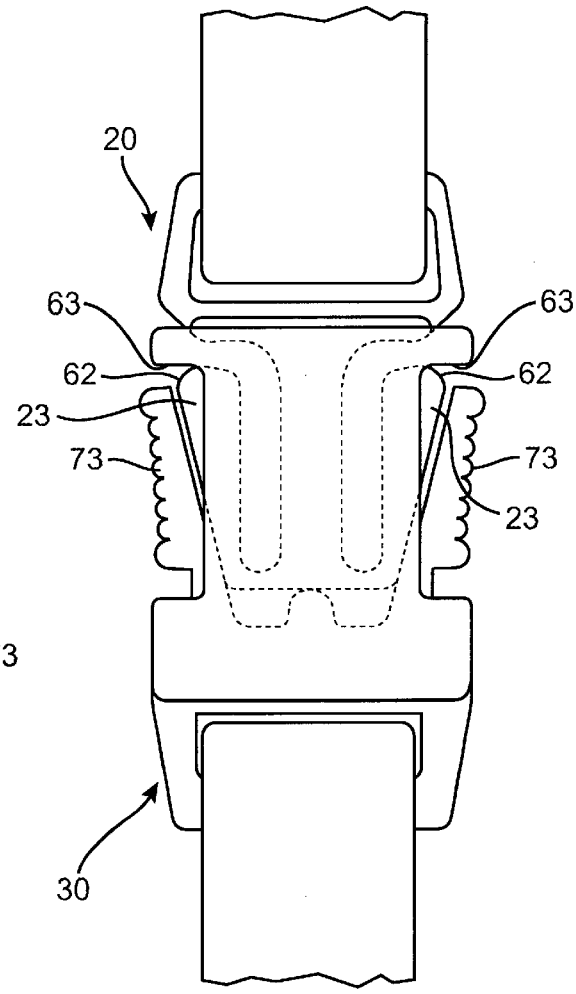
FIG. 5B—Buckle side view, engaged.

As best seen in FIG. 5, finger assists (73) are optionally provided to facilitate release of the insert (20) from the manual, locked position. The finger assists (73) are two resilient pads hidgedly attached to the receptacle (30) near the locking slots (56) such that each pad extends in front of the exterior of each of the locking slots (56). The attachment points of the assists to the receptacle serve as a springing, resilient hinge. When the user desires to manually disengage the two members, the assists (73) are pinched together pushing the arms (23) and thereby disengaging the tips (62) from the edges (63) of the slots. The finger assists (73) are particularly useful when the buckles are small relative to the user's finger.

Usually, the base (21) of the insert is broad, extending away from the post (22) and arms (23). Lanyard fastening means, for instance, a slot or an eyelet, is provided to accommodate a lanyard or rope. Similarly, lanyard fastening means is provided at the back side of the closed end of the receptacle. Alternatively, card holding means, for instance, a clip or a card pouch, is provided.

In the foregoing, the present invention has been described with reference to suitable embodiments, but these embodiments are only for purposes of understanding the invention and various alterations or modifications are possible so long as the present invention does not deviate from the claims that follow.

What is claimed is:

1. An optionally manual or automatic disengaging buckle comprising separable cooperating insert and receptacle members couplable in a first and second orientation, said receptacle comprising a generally flat rectangularly tubular body having inner and outer side walls relatively wider than top and bottom walls, an open first end for receiving the insert and a closed second end with an inner surface, the inner surface having variable insert stop means including a raised region with a first edge proximate to the inner wall and a second edge proximate to the outer wall, said insert stop located equidistant between the top and bottom walls and protruding a predetermined distance toward the first end with the first edge protruding relatively further than the second edge, and said top and bottom walls including locking means including paired slots located in the top and bottom walls at an equivalent predetermined distance from the first end; and said insert comprising a base having a central post extending away from the base, said post including a tip, inner, outer, upper and lower sides, and also including variable insert stop means at the tip having a centrally located stop region with inner and outer edges, the outer edge extending relatively further from the base than the inner edge, said insert additionally comprising upper and lower opposing resilient arms with outer sides facing away from the post, the arms having first and second ends and located on opposite upper and lower sides of the post, the first ends springedly attached proximate to the tip of the post with the arms extending alongside of and diagonal to the post and second ends spaced apart relatively further than the distance between the top and bottom walls of the receptacle, the tips of the second ends flat and generally parallel to the base, and the arms and post dimensioned to fit within the receptacle by compression of the resilient arms toward the post as the insert is moved into the receptacle, such that, when the insert is inserted into the receptacle in the first orientation, the insert stop of the receptacle reciprocally cooperates with the insert stop of the insert, thereby providing full penetration of the insert and snapping engagement of arms into the corresponding locking slots, and when the insert is inserted in the converse orientation relative to the receptacle, the insert stop of the receptacle is adverse to the insert stop of the insert, thereby preventing full penetration of the insert and preventing the flat tips of the arms from entering the locking slot.

2. The disengaging buckle of claim 1 wherein the locking slot means include resilient finger assists hingedly attached to an end of the locking slots, said finger assists including a body extending in front of each slot and exterior to the receiving member such that, when the insert is fully engaged the finger assists register with the locking tabs.

3. The disengaging buckle of claim 1 wherein the stop of the receiving member extends from the top wall to the bottom wall and the stop region on the tip of the insert post extends from the upper to the lower side of the post.

4. The disengaging buckle of claim 1 wherein the base of the insert additionally includes a lanyard fastening means.

5. The disengaging buckle of claim 1 wherein the base of the insert additionally includes a card holding means.

6. The disengaging buckle of claim 1 wherein the second end of the receiving member additionally includes a lanyard fastening means.

7. The disengaging buckle of claim 1 wherein the second end of the receiving member additionally includes a card holding means.

8. An optionally manual or automatic disengaging buckle comprising separable cooperating insert and receptacle members couplable in a first and second orientation, said receptacle comprising a generally flat rectangularly tubular body having inner and outer side walls relatively wider than top and bottom walls, an open first end for receiving the insert and a closed second end with an inner surface, the inner surface having a variable insert stop means including a raised region located equidistant between the top and bottom walls and protruding a predetermined distance toward the first end, the raised region including a first edge proximate to the inner wall and a second edge proximate to the outer wall, the first edge protruding relatively further toward the open end than the second edge, said top and bottom walls including a locking means having a pair of opposing slots located in the top and bottom walls of the receptacle at an equivalent predetermined distance from the first end; and said insert comprising a base with a central post and paired upper and lower resilient arms having first and second ends, the first ends springedly attached to the base on either side of the post and spaced apart by the distance between the top and bottom wall of the receptacle, said arms extending along the post, the second ends dimensioned to fit within the receptacle by compression of the arms towards each other as the insert is moved into the receptacle, the arms additionally including a locking means comprising tabs extending from outer sides of the arms and having a flat trailing end facing and generally parallel to the base, lateral sides spaced in excess of the distance between the top and bottom walls of the receptacle, and a shoulder therebetween, the central post having a variable insert stop means located at the distal tip, said stop means including inner and outer edges, the outer edge extending relatively further from the base than the inner edge such that, when the insert is inserted into the receptacle in the first orientation, the stop means of the receptacle reciprocally cooperates with the stop means of the insert thereby permitting full penetration of the insert and snapping engagement of the trailing edge of the locking tabs into the corresponding locking slots, and when the orientation of the insert is inserted in the converse orientation relative to the receptacle, the stop means of the receptacle is adverse to the stop means of the insert preventing full penetration of the insert and preventing the trailing edge of the locking tab from entering the locking slot.

9. The disengaging buckle of claim 8 wherein the locking slot means include a resilient finger assists hingedly attached to an end of the locking slots, said finger assists including a body extending in front of each slot and exterior to the receiving member such that, when the insert is fully engaged the finger assists register with the locking tabs.

10. The disengaging buckle of claim 8 wherein the stop of the receiving member extends from the top wall to the bottom wall and the stop region on the tip of the post extends from the upper to the lower side of the post.

11. The disengaging buckle of claim 8 wherein the base of the insert additionally includes a lanyard attachment means.

12. The disengaging buckle of claim 8 wherein the base of the insert additionally includes a card holding means.

13. The disengaging buckle of claim 8 wherein the second end of the receiving member additionally includes a lanyard attachment means.

14. The disengaging buckle of claim 8 wherein the second end of the receiving member additionally includes a card holding means.

* * * * *